US007243656B2

(12) United States Patent
Kushihashi et al.

(10) Patent No.: US 7,243,656 B2
(45) Date of Patent: Jul. 17, 2007

(54) MACHINE FOR MANUFACTURING ROD-LIKE ARTICLE

(75) Inventors: Shigenobu Kushihashi, Tokyo (JP); Susumu Shimizu, Tokyo (JP); Susumu Shimada, Tokyo (JP); Hiroshi Okamoto, Tokyo (JP); Toru Kano, Tokyo (JP); Takashi Sato, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 410 days.

(21) Appl. No.: 10/433,352

(22) PCT Filed: Dec. 12, 2001

(86) PCT No.: PCT/JP01/10900

§ 371 (c)(1),
(2), (4) Date: Jun. 2, 2003

(87) PCT Pub. No.: WO02/47496

PCT Pub. Date: Jun. 20, 2002

(65) Prior Publication Data

US 2004/0025889 A1 Feb. 12, 2004

(30) Foreign Application Priority Data

Dec. 13, 2000 (JP) ..... 2000-378903
Jan. 18, 2001 (JP) ..... 2001-010351

(51) Int. Cl.
*A24C 5/14* (2006.01)

(52) U.S. Cl. ..... 131/60; 131/58

(58) Field of Classification Search ..... 131/58, 131/60, 27.1, 84.3
See application file for complete search history.

(56) References Cited

U.S. PATENT DOCUMENTS 3,716,443 A * 2/1973 Preston ..... 156/441
4,541,826 A * 9/1985 Warner ..... 493/48

FOREIGN PATENT DOCUMENTS

| | | | |
|---|---|---|---|
| JP | 53-18800 | A | 2/1978 |
| JP | 61-212272 | A | 9/1986 |
| JP | 62-44159 | A | 2/1987 |
| JP | 11-069964 | A | 3/1999 |
| JP | 2997246 | B1 | 10/1999 |
| JP | 2000-253864 | A | 9/2000 |

* cited by examiner

*Primary Examiner*—Dionne W. Mayes
(74) *Attorney, Agent, or Firm*—Birch, Stewart, Kolasch & Birch, LLP

(57) ABSTRACT

A manufacturing machine for rod-shaped articles comprises a wrapping section (4) for forming a rod-shaped article by wrapping a filler material in a wrapper. The wrapping section has a forming bed (6) for guiding a garniture tape (10), which is used to form the rod-shaped article, in travel. The manufacturing machine further comprises a cooling system for cooling the forming bed (10). The cooling system is provided with cooling passages (43, 45, 47, 49, 143, 145, 149) formed in portions 6A to 6D of the forming bed (6) and a circuit for supplying a coolant to the cooling passages.

14 Claims, 12 Drawing Sheets

MACHINE FOR MANUFACTURING ROD-LIKE ARTICLE

This application is the national phase under 35 U.S.C. §371 of PCT International Application No. PCT/JP01/10900 which has an International filing date of Dec. 12, 2001, which designated the United States of America.

TECHNICAL FIELD

The present invention relates to a manufacturing machine for manufacturing rod-shaped articles such as cigarette rods, filter rods, etc.

BACKGROUND ART

A manufacturing machine for rod-shaped articles of this type includes a wrapping section. The wrapping section forms a rod-shaped article by continuously wrapping a filler material, such as cut tobacco or a filter material, in a wrapper as the filler material and the wrapper, along with an endless garniture tape, pass through the wrapping section.

More specifically, the garniture tape runs sliding on a forming bed that forms the lower side part of the wrapping section, while the filler material and the wrapper run sliding on a plurality of forming molds that form the upper side parts of the wrapping section. As the manufacturing operation of the manufacturing machine is speeded up, therefore, the respective traveling speeds of the garniture tape, filler material, and wrapper also increase. The sliding contact of the garniture tape with the forming bed and the sliding contact of the filler material and the wrapper with the forming molds generate substantial frictional heat in the wrapping section, thereby overheating the wrapping section.

Overheating of the wrapping section shortens the lifetime of the garniture tape. More specifically, manufacture of a conventional garniture tape includes a process of connecting the opposite ends of a band made of linen fibers, a process of applying an adhesive agent to the band, and a process of then hot-molding and elongating the band to a given length. Therefore, overheating the garniture tape lowers the bond strength of the adhesive agent between the linen fibers. Thus, the lifetime of the garniture tape is supposed to be shortened as the tensile strength of the garniture tape is quickly reduced to an allowable level or below.

More specifically, if the manufacturing machine is operated at manufacturing speeds of 4,000 cigarettes, 8,000 cigarettes, or 14,000 cigarettes per minute in the case where the manufacturing machine is applied to the manufacture of cigarette rods, the garniture tape has lifetimes of 12 to 16 hours, 6 to 10 hours, or 3 to 6 hours, respectively. Thus, the higher the manufacturing speed of the manufacturing machine, the higher the frequency of change of the garniture tape is, and the lower the operating efficiency or production capacity of the manufacturing machine is.

If the filler material is cut tobacco, moreover, overheating of the wrapping section positively causes the flavor and taste of the cut tobacco itself to worsen.

The object of the present invention is to provide a manufacturing machine for rod-shaped articles, designed so that a wrapping section in the manufacturing machine can be effectively prevented from overheating if the manufacture of the rod-shaped articles is speeded up.

DISCLOSURE OF THE INVENTION

A manufacturing machine for rod-shaped articles according to the present invention comprises: a wrapping section supplied with a filler material and a wrapper and capable of forming a rod-shaped article by wrapping the filler material in the wrapper, the wrapping section including an endless tape, used to form the rod-shaped article and capable of running the wrapper together with the filler material in one direction, and a forming bed for guiding the endless tape in travel; and cooling means for cooling the wrapping section, the cooling means including a cooling passage formed at least in the forming bed and a circuit for circulating in and supplying a cooling medium to the cooling passage.

According to the manufacturing machine described above, the cooling passage is formed in the forming bed of the wrapping section, so that the forming bed is compulsorily cooled as the cooling medium is supplied to the cooling passage. Thus, the endless tape can be prevented from overheating, so that the lifetime of the endless tape is lengthened. In consequence, the frequency of change of the endless tape is lowered, and the operating efficiency or production capacity of the manufacturing machine is improved.

Preferably, the forming bed is divided into a plurality of regions adjoining one another in the traveling direction of the wrapper, and independent cooling passages are formed in these regions, individually. Therefore, the regions are cooled independently as the cooling medium is supplied to their respective cooling passages. In consequence, the forming bed can be uniformly cooled throughout its length even if the forming bed is long.

More specifically, the forming bed has an upper portion and a lower portion, and the respective cooling passages of the individual regions are formed independently between the upper portion and the lower portion. In this case, the forming bed may have therein a heat pipe extending in the traveling direction of the wrapper. The heat pipe makes the temperature of the forming bed uniform throughout its length.

The circuit may include a regulator used to adjust the temperature of the cooling medium and having a cooler and a heater, a feed line for feeding the cooling medium from the regulator to the cooling passages, and a return line for returning the cooling medium from the cooling passage to the regulator.

The heater of the regulator can finely control the temperature of the cooling medium, thereby preventing sweating that is attributable to overcooling of the forming bed and also converting the cooling medium into a heating medium. When the manufacturing machine is operated in a cold district, in this case, the forming bed can be warmed if the heating medium is supplied to the cooling passages of the forming bed before the start of operation of the manufacturing machine.

The circuit may further include a temperature sensor for detecting the temperature of the cooling medium in the return line. The temperature of the coolant detected by means of the temperature sensor indicates heating temperature for the forming bed. Therefore, the supply of the cooling medium to the cooling passage can be adjusted in accordance with the temperature detected by means of the temperature sensor, so that both overheating and overcooling of the forming bed can be prevented.

The wrapping section further includes an upper wrapping section located over the forming bed. The upper wrapping section has a compression mold capable of defining a compression molding passage for the filler material in cooperation with the forming bed, a first mold located on the lower-stream side of the compression mold as viewed in the traveling direction of the wrapper and capable of curving one side edge of the wrapper in a circular arc to cover the filler material, and a second mold located on the lower-stream side of the first mold as viewed in the traveling direction of the wrapper and capable of curving the other side edge of the wrapper in a circular arc to cover the filler material. In this case, the cooling means further includes a cooling passage formed at least in the compression mold, out of the aforesaid molds, and the cooling passage is supplied with the cooling medium from the circuit.

As the filler material and the wrapper pass through the compression mold, friction between the compression mold and the filler material may possibly overheat the filler material. As the cooling medium is supplied to the cooling passage in the compression mold, however, overheating of the compression mold or the filler material can be prevented. If the filler material is cut tobacco, the flavor and taste of the cut tobacco cannot be worsened by overheating.

The forming bed may be divided into portions for the individual regions. In this case, each regions of the forming bed may have therein a heat pipe extending in the traveling direction of the wrapper. These heat pipes make the respective temperatures of their corresponding regions of the forming bed uniform in the traveling direction of the wrapper.

The manufacturing machine may further comprise vibrating means for vibrating the compression mold with ultrasonic waves. If the filler material is cut tobacco, the vibration of the compression mold reduces fragmentation of the cut tobacco.

The first mold includes a short holder for curving the one side edge of the wrapper and a side edge guide for guiding the other side edge of the wrapper. In this case, the cooling means further includes cooling passages formed individually in the short holder, side edge guide, and second mold, and these cooling passages are supplied with the cooling medium from the circuit.

If all the parts that constitute the upper wrapping section are provided individually with the cooling passages, as described above, overheating of the upper wrapping section can be also prevented securely.

The circuit may further include branch lines diverging from the feed line and used to supply the cooling medium to the cooling passages, individually, temperature sensors for detecting the respective temperatures of the parts of the wrapping section having the cooling passages and outputting detection signals, individually, flow regulating valves inserted in the cooling passages, individually, and control means for adjusting respective openings of the corresponding flow regulating valves in accordance with the detection signals from the temperature sensors. In this case, the circuit can independently control the respective temperatures of the individual parts of the wrapping section.

The wrapping section may be supplied with cut tobacco or a filter material as the filler material. In the former case, the manufacturing machine is a cigarette manufacturing machine. In the latter case, the manufacturing machine is a filler rod manufacturing machine.

BEST MODE FOR CARRYING OUT THE INVENTION

Figure 1:
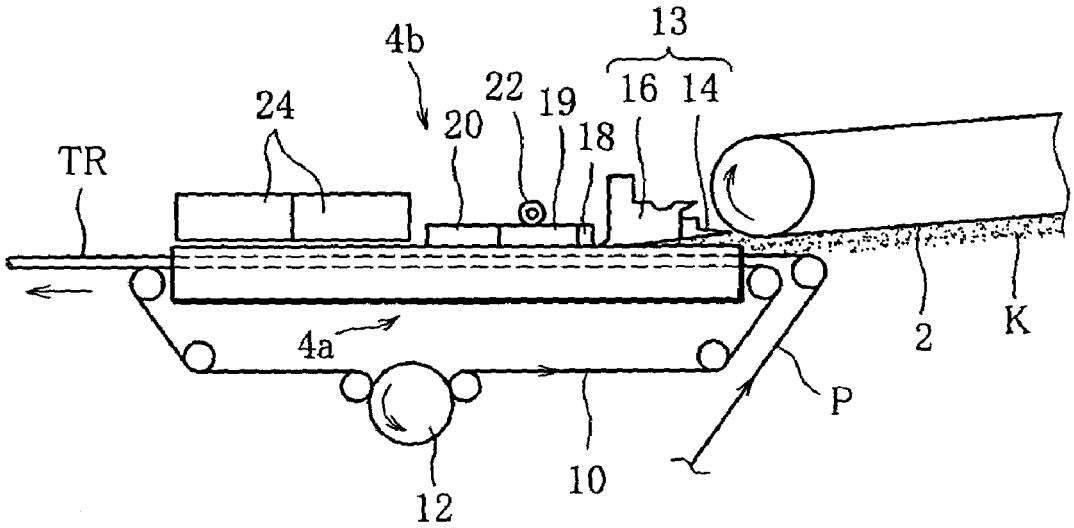
FIG. 1 is a schematic view showing a wrapping section of a cigarette manufacturing machine according to a first embodiment.

As shown in FIG. 1, a cigarette manufacturing machine according to a first embodiment comprises an endless tobacco band 2. The tobacco band 2 attracts cut tobacco K in layers to a lower surface thereof. As the tobacco band 2 travels, the cut tobacco K is transferred to a wrapping section 4.

The wrapping section 4 includes a lower wrapping section 4*a* and an upper wrapping section 4*b*. The lower wrapping section 4*a* has a forming bed 6. The forming bed 6 is located ahead of the tobacco band 2 and extends in the direction of transfer of the cut tobacco K.

Figure 2:
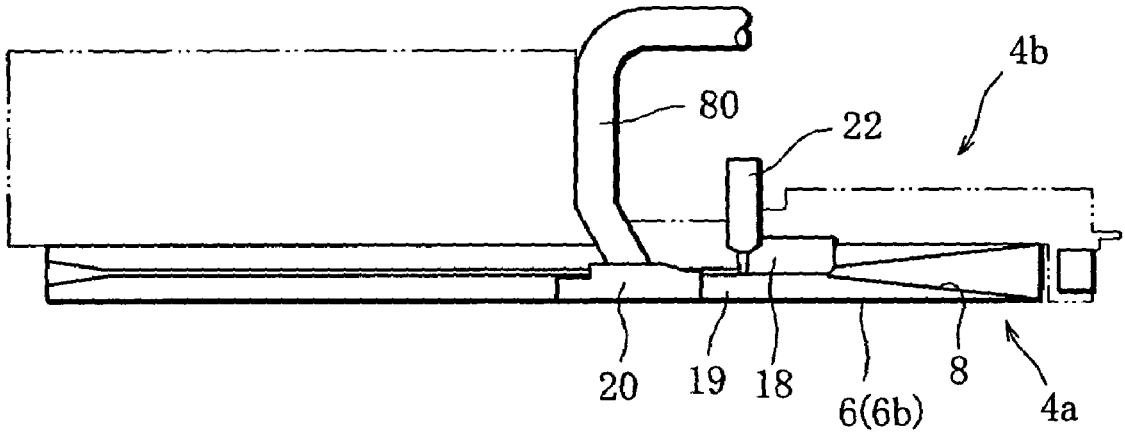
FIG. 2 is a plan view showing the wrapping section of FIG. 1.

As shown in FIG. 2, a molding groove 8 is formed on the upper surface of the forming bed 6. The molding groove 8 extends from the upper-stream end of the forming bed 6 on the side of the tobacco band 2 toward the lower-stream end. More specifically, the molding groove 8 is substantially flat on the upper-stream end of the forming bed 6, and has a radius of curvature that gradually decreases toward the lower-stream end of the forming bed 6. That part of the molding groove 8 which is situated on the lower-stream side of the forming bed 6 has a substantially semicircular cross section.

The molding groove 8 guides an endless forming tape or a so-called garniture tape 10. As a driving drum 12 rotates, the garniture tape 10 travels in one direction or the direction of transfer of the cut tobacco K in the molding groove 8.

A paper P is fed on the garniture tape 10. The paper P travels together with the garniture tape 10. The paper P is delivered from a roll (not shown).

The upper wrapping section 4*b* includes a compression mold 13 for the cut tobacco layer L. The compression mold 13, which is located at the upper-stream end of the forming bed 6, has a shoe 14 and a tongue 16. Further, the upper wrapping section 4*b* includes first and second molds for the paper P. The first and second molds are successively arranged on the lower-stream side of the tongue 16. The first mold has a so-called short holder 18 and a front strip 19 for use as a side edge guide. The second mold is called a long holder 20.

A paste nozzle 22 is located between the short holder 18 and the long holder 20. The paste nozzle 22 faces the front strip 19. Further, two heaters 24 are successively arranged on the lower-stream side of the long holder 20.

The shoe 14 separates the cut tobacco K from the tobacco band 2 and feeds it onto the paper P. Thus, the cut tobacco K, along with the paper P, passes under the tongue 16. More specifically, the lower surface of the tongue 16 and the molding groove 8 defines a compression molding passage for the cut tobacco K in cooperation with each other. As the cut tobacco K, along with the paper P, passes through the compression molding passage, the passage compresses and molds the cut tobacco K into a given sectional shape or circular sectional shape. As this is done, therefore, the paper P is bent to have a U-shaped cross section.

As the cut tobacco K passes through the short holder 18, thereafter, the short holder 18 mold one side edge portion of the paper P into a circular arc, whereupon the one side edge portion is put on the cut tobacco K. On the other hand, the other side edge portion of the paper P is guided by the front strip 19. After the short holder 18 is passed by the other side edge portion, the paste nozzle 22 applies paste to the other side edge portion.

As the cut tobacco K, along with the paper P, passes through the long holder 20, moreover, the long holder 20 molds the other side edge portion of the paper P into a circular arc. In consequence, the other side edge portion is lapped on the one side edge portion of the paper, and at the same time, bonded to it with the aforesaid paste. At this point of time, the cut tobacco K is entirely wrapped in the paper P and formed into a tobacco rod TR, and the tobacco rod TR is delivered continuously from the long holder 20.

As the tobacco rod TR passes through the heaters 24 in succession, thereafter, the seam of the tobacco rod TR or the opposite side edge portions of the paper P bonded together are dried, and the tobacco rod TR is cut into cigarette rods of a given length in a cutting section (not shown). Each cigarette rod is twice as long as each cigarette.

The wrapping section 4 of the cigarette manufacturing machine described above is further provided with a cooling system. The following is a detailed description of this cooling system.

Figure 3:
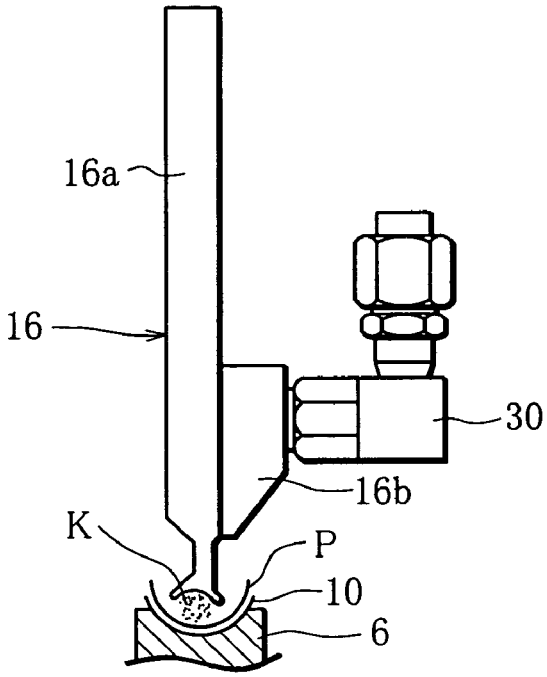
FIG. 3 is a view showing the rear end face of a tongue of FIG. 2.
Figure 4:
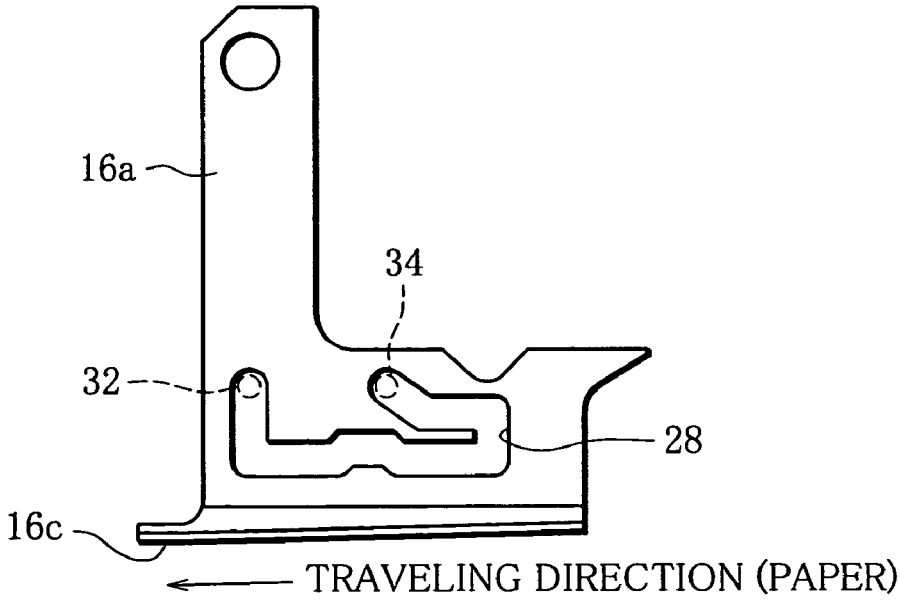
FIG. 4 is a view showing the body of the tongue of FIG. 2.

First, as shown in FIGS. 3 and 4, the tongue 16 has a body 16*a* and a cover 16*b* that covers a side face of the body 16*a* in a liquid-tight manner. A lower surface 16*c* of the body 16*a* forms a ceiling wall of the aforementioned compression molding passage. A groove 28 is formed in the inner side face of the body 16*a*. The groove 28 extends in the axial direction of the body 16*a*, and opposite end portions of the groove 28 are bent upward.

Figure 7:
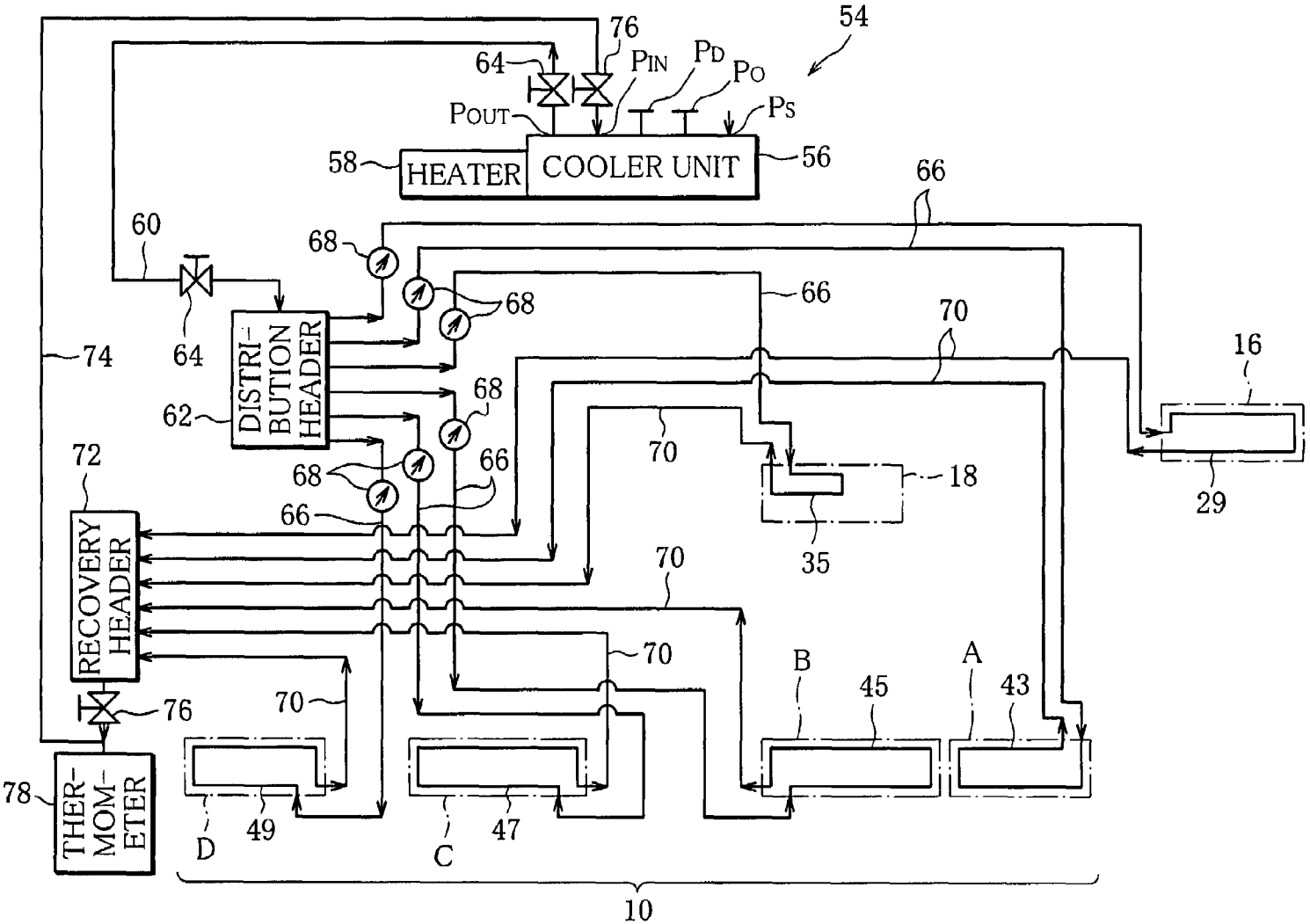
FIG. 7 is a diagram showing a circuit for supplying a coolant to cooling passages of the wrapping section.

The groove 28 is covered by the cover 16*b* and forms a cooling passage 29 (see FIG. 7). The outer surface of the body 16*a* is provided with an inlet connector 30 and an outlet connector (not shown). The inlet connector 30 communicates with one end of the groove 28, which is located on the lower-stream side with respect to the running direction of the paper P, by means of a port 32, while the outlet connector communicates with the other end of the groove 28 by means of a port 34.

Figure 5:
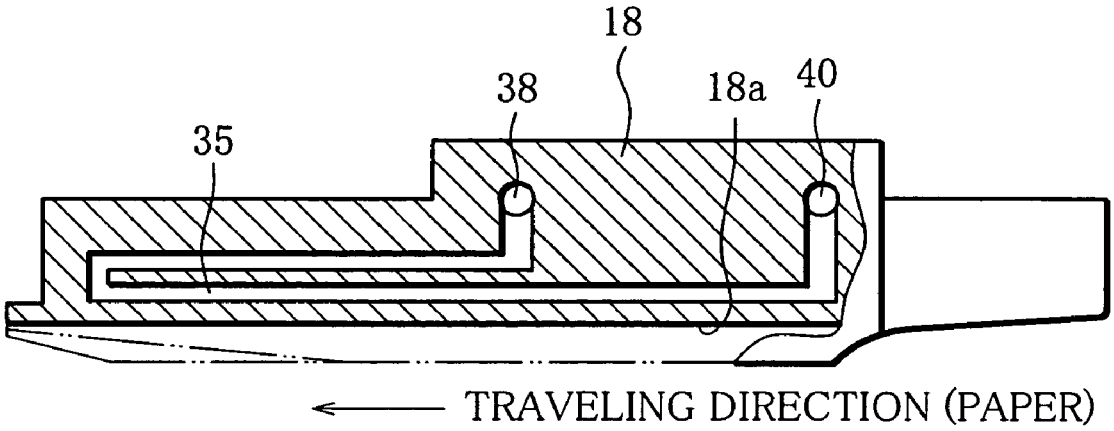
FIG. 5 is a cutaway plan view of a short holder of FIG. 1.

As shown in FIG. 5, the short holder 18 has a guide surface 18*a* that guides the one side edge portion of the paper P in being folded and run. A cooling passage 35 is formed in the short holder 18. The cooling passage 35 is located near the guide surface 18*a* and extends in the traveling direction of the paper P. As viewed in the traveling direction of the paper P, the lower-stream side portion of the cooling passage 35 has a parallel dual structure. One end of the cooling passage 35 communicates with an inlet connector by means of a port 38, while the other end of the cooling passage 35 communicates with an outlet connector by means of a port 40.

Figure 6:
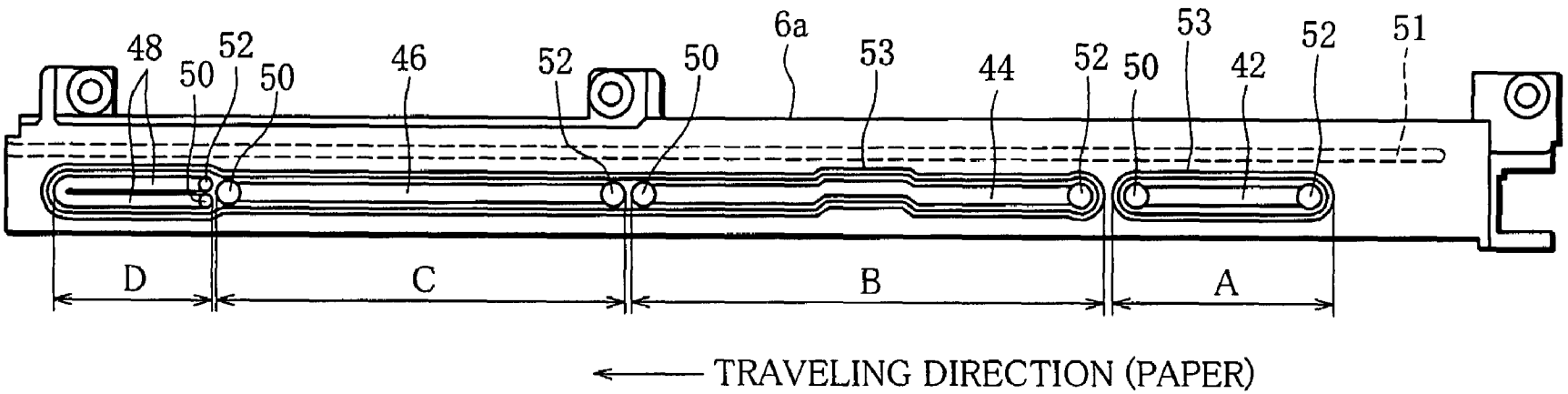
FIG. 6 is a plan view showing a lower portion of a forming bed of FIG. 1.

Further, the aforementioned forming bed 6 has an upper portion and a lower portion. FIG. 6 shows the lower portion 6*a* of the forming bed 6. The lower portion 6*a* is divided into regions A to D, and these regions successively adjoin one another in the traveling direction of the paper P. More specifically, the region A is located under the aforesaid tongue 16, and the region B is located under the short holder 18 and the long holder 20. The regions C and D are located under the heaters 24.

The regions A to D have grooves 42, 44, 46 and 48, respectively, and these grooves, in conjunction with an upper portion 6*b* (see FIG. 2) of the forming bed 6, form independent cooling passages 43, 45, 47 and 49 (see FIG. 7), individually. The grooves 42 to 48 extend in the traveling direction of the paper P, while the groove 48 has the shape of a laid U. Both ends of the U-shaped groove 48 are located on the upper-stream side with respect to the traveling direction of the paper P. One end of each of the grooves 42 to 48 is connected to an inlet connector through each corresponding one of ports 50, while their respective other ends are connected to outlet connectors through ports 52, individually. The ports 50 of the grooves 42, 44 and 46 communicate individually with the respective lower-stream ends of their corresponding grooves as viewed in the traveling direction of the paper P.

Further, the lower portion 6*a* has a heat pipe 51 therein, and the heat pipe 51 extends in the traveling direction of the paper P. The heat pipe 51 is a thermal conduction element that has a closed container in which a working fluid is vacuum-filled, and a capillary structure in the inner wall of the closed container. If a part of the heat pipe 51 is heated, heat quickly moves the in the heat pipe 51, whereupon the temperature of the heat pipe 51 is made uniform. The heat pipe 51 makes its ambient temperature uniform. In FIG. 6, reference numerals 53 denote seals.

FIG. 7 shows a circuit for supplying a coolant to the cooling passages. The circuit is provided with a temperature regulator 54. The temperature regulator 54 includes a cooler unit 56 and a heater 58, and the cooler unit 56 has a pump and a cooler therein.

The cooler unit 56 has a discharge port $P_{OUT}$, return port $P_{IN}$, drain port $P_{OUT}$, overflow port $P_O$, and water supply port $P_S$. The discharge port $P_{OUT}$ is connected to a distribution header 62 through a feed line 60. The feed line 60 is fitted with two valves 64, and these valves 64 are located on the sides of the cooler unit 56 and the distribution header 62, individually.

A plurality of distribution lines 66 extend from the distribution header 62, and these distribution lines 66 are connected individually to the cooling passage 29 of the tongue 16, the cooling passage 35 of the short holder 18, and the cooling passages 43, 45, 47 and 49 in the forming bed 6 through the inlet connectors. Each distribution line 66 is fitted with a flow meter 68.

On the other hand, recovery lines 70 extend individually from the respective outlet connectors of the cooling passages 29 to 49, and these recovery lines 70 are connected to a recovery header 72. A return line 74 extends from the recovery header 72, and the return line 74 is connected to the return port $P_{IN}$ of the cooler unit 56.

The return line 74 is also fitted with two valves 76, and these valves 76 are located on the sides of the recovery header 72 and the cooler unit 56, individually. Further, a thermometer 78 is connected to the return line 74. The thermometer 78 detects the temperature of the coolant discharged from the valve 76 into the recovery header 72.

During the operation of the cigarette manufacturing machine, the coolant is cooled to a given temperature by means of the cooler in the cooler unit 56, and is discharged through the discharge port $P_{OUT}$ of the cooler unit 56. The discharged coolant is fed to the distribution header 62 through the feed line 60, and distributed from the distribution header 62 to the cooling passages 29, 35, 43, 45, 47 and 49 of the tongue 16, short holder 18, and forming bed 6 through the distribution lines 66, individually. The coolant flows through the individual cooling passages, thereafter, it is recovered through the recovery lines 70 to the recovery header 72, and then is returned from the recovery header 72 to the return port $P_{IN}$ of the cooler unit 56 through the return line 74.

As the coolant is fed to the individual cooling passages in this manner, the tongue 16, short holder 18, and forming bed 6 are compulsorily cooled with the coolant. Therefore, the tongue 16, short holder 18, and forming bed 6, that is, the garniture tape 10 and the cut tobacco K, can be prevented from overheating.

Thus, the lifetime of the garniture tape 10 lengthens, and the frequency of change of the garniture tape 10 can be lowered considerably. In consequence, the operating efficiency of the cigarette manufacturing machine is enhanced, so that the production capacity of the cigarette manufacturing machine is improved.

Since the cut tobacco K is also prevented from overheating, as mentioned before, on the other hand, the flavor and taste of the cut tobacco K cannot be damaged, and the quality of cigarette rods can be maintained with stability.

The forming bed 6 is longer than the tongue 16 and the short holder 18. Since the regions A to D of the forming bed 6 are independently cooled by means of the cooling passages 43, 45, 47 and 49, however, the cooling effect of the forming bed 6 is high. Therefore, the forming bed 6 can be kept at a given temperature or below throughout its length. Further, the heat pipe 51 in the forming bed 6 fulfills its function to make the temperature distribution of the forming bed 6 uniform throughout its length.

The temperature of the coolant that is detected by means of the thermometer 78 of the return line 74 indicates the cooled state of the tongue 16, short holder 18, and forming bed 6. If there is a possibility of the tongue 16, short holder 18, and forming bed 6 being overcooled, based on the result of the detection by means of the thermometer 78, the respective openings of the valves 64 and 76 are adjusted to reduce the supply of the coolant or to heat the coolant by means of the heater 58 of the temperature regulator 54 as well as to reduce the supply of the coolant. In consequence, there is no possibility of various parts of the wrapping section sweating.

If the cigarette manufacturing machine is operated in a cold district, the circuit feeds the respective cooling passages of the tongue 16, short holder 18, and forming bed 6 with the coolant as a heating medium heated by means of the heater 58 of the temperature regulator 54, after the operation of the cigarette manufacturing machine is started. The tongue 16, short holder 18, and forming bed 6 can be warmed by doing this.

The long holder 20 has no cooling passage. As shown in FIG. 2, however, the cooling system may further comprise an air hose 80 that extends from the long holder 20. The air hose 80 sprays the long holder 20 with cooling air or heating air, thereby preventing the long holder 20 from overheating or overcooling.

Figure 8:
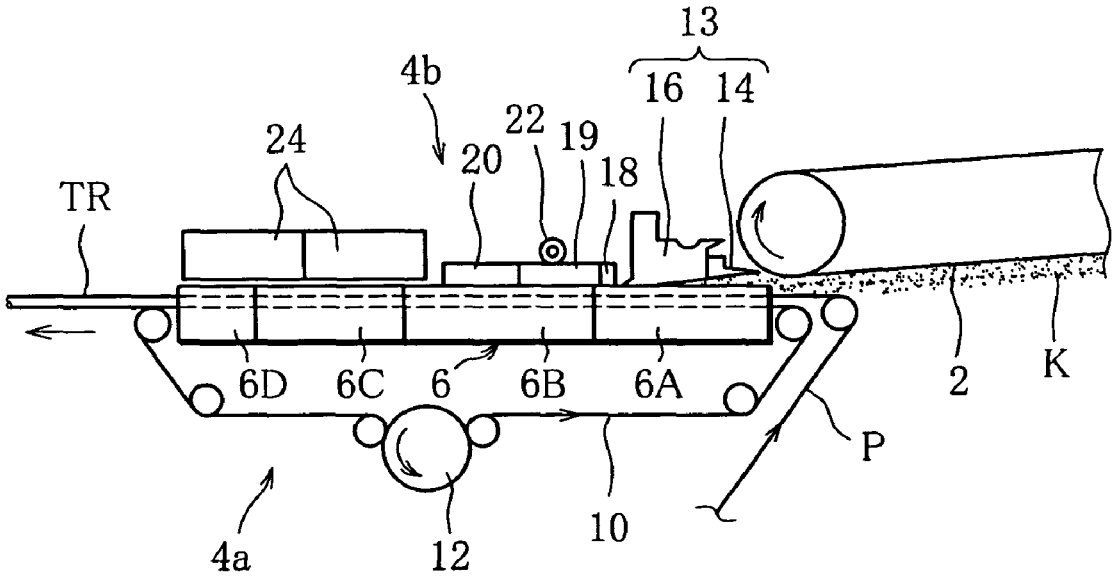
FIG. 8 is a schematic view showing a wrapping section of a cigarette manufacturing machine according to a second embodiment.

Referring to FIG. 8, there is shown a cigarette manufacturing machine according to a second embodiment. In the description of the cigarette manufacturing machine of the second embodiment to follow, like reference numerals are used to designate those portions which have the same functions as their counterparts of the cigarette manufacturing machine according to the first embodiment.

In the case of the cigarette manufacturing machine of FIG. 8, a forming bed 6 is divided into a plurality of portions 6A to 6D, and these portions 6A to 6D successively adjoin one another in the traveling direction of the paper P, as shown in FIG. 8. These portions 6A to 6D correspond to the regions A to D, respectively, of the forming bed 6 of the first embodiment.

Figure 9:
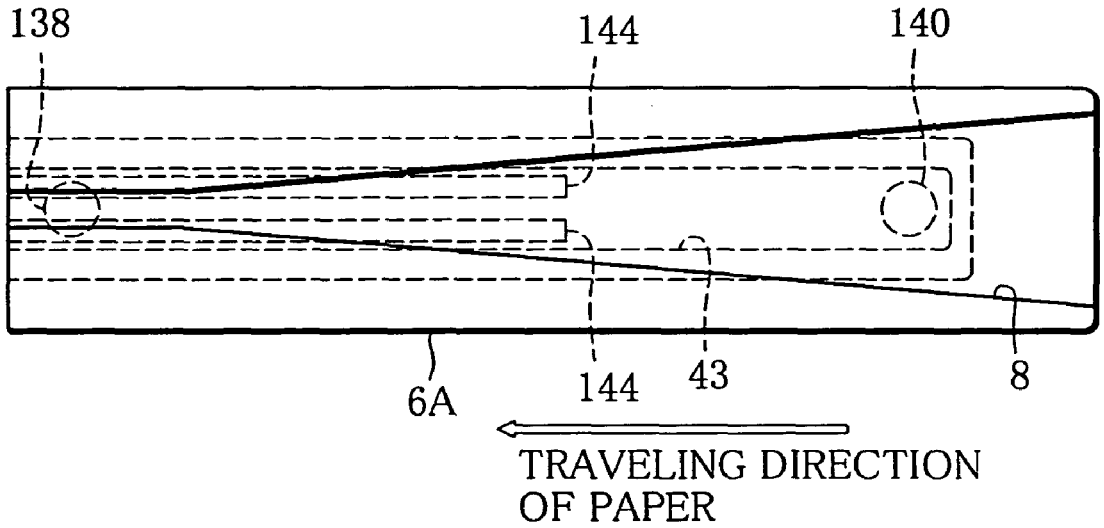
FIG. 9 is a plan view showing a portion 6A of a forming bed of FIG. 8.
Figure 10:
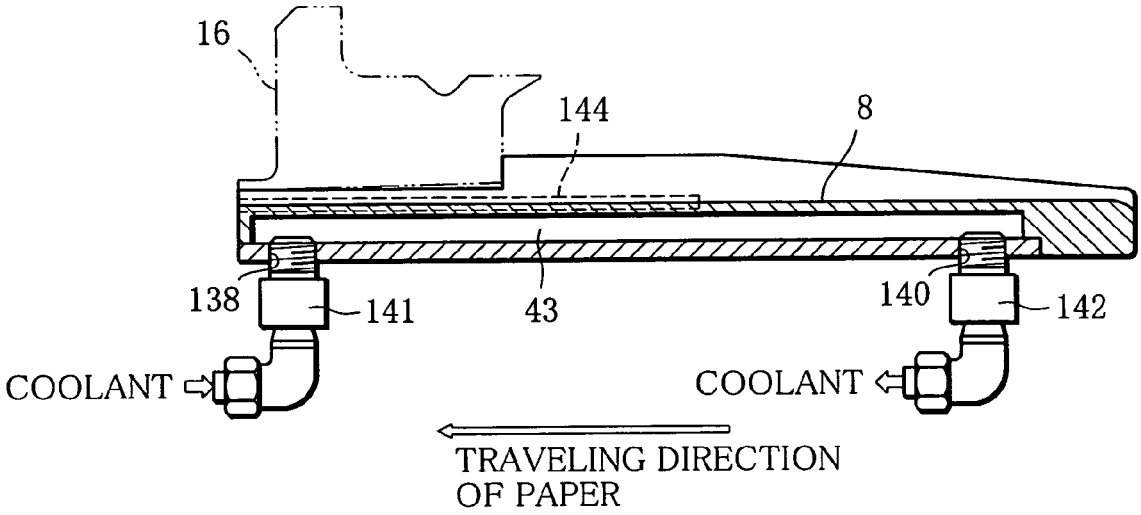
FIG. 10 is a sectional view of the portion 6A.
Figure 11:
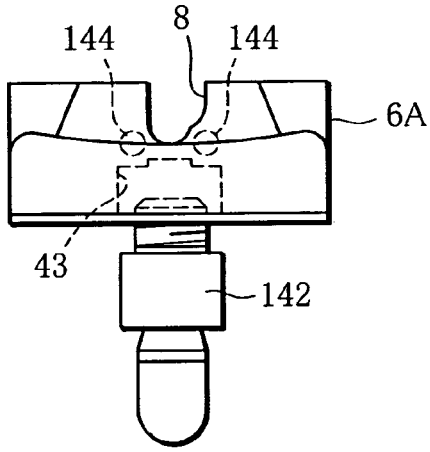
FIG. 11 is a view showing the front end face of the portion 6A.

The details of the portion 6A are shown in FIGS. 9 to 11. A cooling passage 143 is formed in the portion 6A. The cooling passage 143 is formed under the molding groove 8 and extends in the traveling direction of the paper P substantially throughout the area of the portion 6A. An inlet connector 141 and an outlet connector 142 are attached to the lower- and upper-stream ends, respectively, of the portion 6A as viewed in the traveling direction of the paper P. The inlet connector 141 communicates with the cooling passage 143 by means of a port 138, while the outlet connector 142 communicates with the cooling passage 143 by means of a port 140.

As seen from FIG. 10, the port 138 is situated corresponding to the outlet of the tongue 16. Thus, the coolant that flows from the inlet connector 141 into the cooling passage 143 through the port 138 can first cool that region of the forming bed 6 which is located under the tongue 6.

As seen from FIG. 11, the cooling passage 143 has a substantially rectangular cross section.

As shown in FIGS. 9 to 11, moreover, the portion 6A has two heat pipes 144 therein. These heat pipes 144, directed from the lower-stream end of the portion 6A toward the upper-stream end, extend to the middle portion of the portion 6A. At the lower-stream end of the portion 6A, the molding groove 8 is interposed between the heat pipes 144 on either side.

The heat pipes 144 have a heat sink function as well as the same functions of the aforementioned heat pipe 51.

Figure 12:
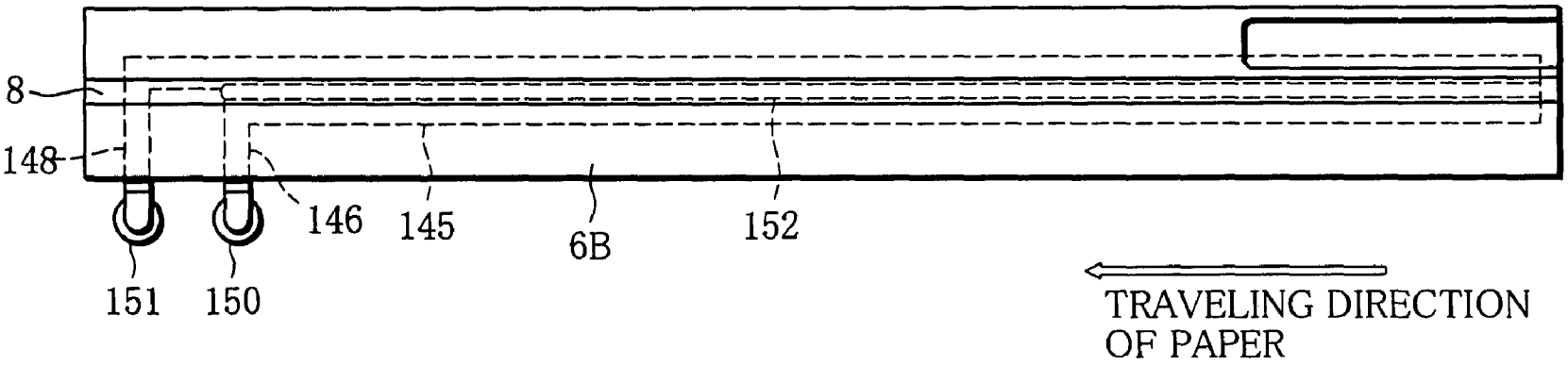
FIG. 12 is a plan view showing a portion 6B of the forming bed of FIG. 8.
Figure 13:
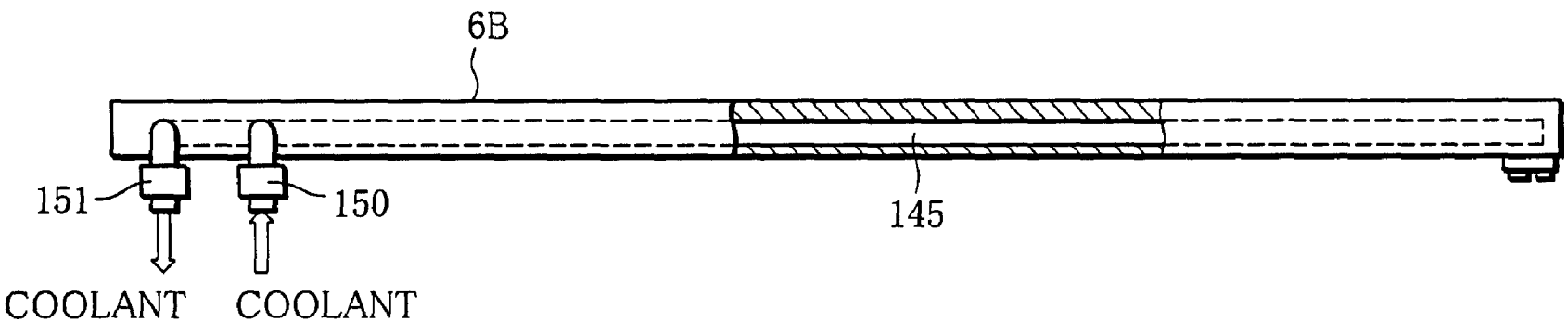
FIG. 13 is a cutaway front view of the portion 6B.
Figure 14:
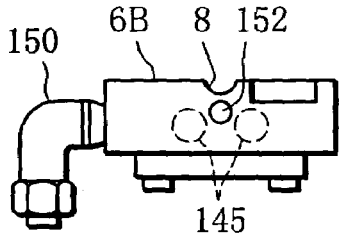
FIG. 14 is a view showing the front end face of the portion 6B.

The portion 6B is shown in FIGS. 12 to 14. A cooling passage 145 is formed in the portion 6B. The cooling passage 145 is located under the molding groove 8. The cooling passage 145, unlike the cooling passage 44 of the first embodiment, is not straight. More specifically, the cooling passage 145 has the shape of an elongate U so as to sandwich the molding groove 8 from both sides, and extends substantially throughout the area of the portion 6B along the paper P.

The opposite ends of the cooling passage 145 terminate in ports 146 and 148 that open in the side face of the lower-stream end of the portion 6B. An inlet connector 150 and an outlet connector 151 are connected to the ports 146 and 148, respectively.

Further, the portion 6B also has therein a heat pipe 152 that resembles the aforementioned heat pipe 144. The heat pipe 152 is situated right under the molding groove 8 and extends from the upper-stream end of the portion 6B to its lower-stream end.

Figure 18:
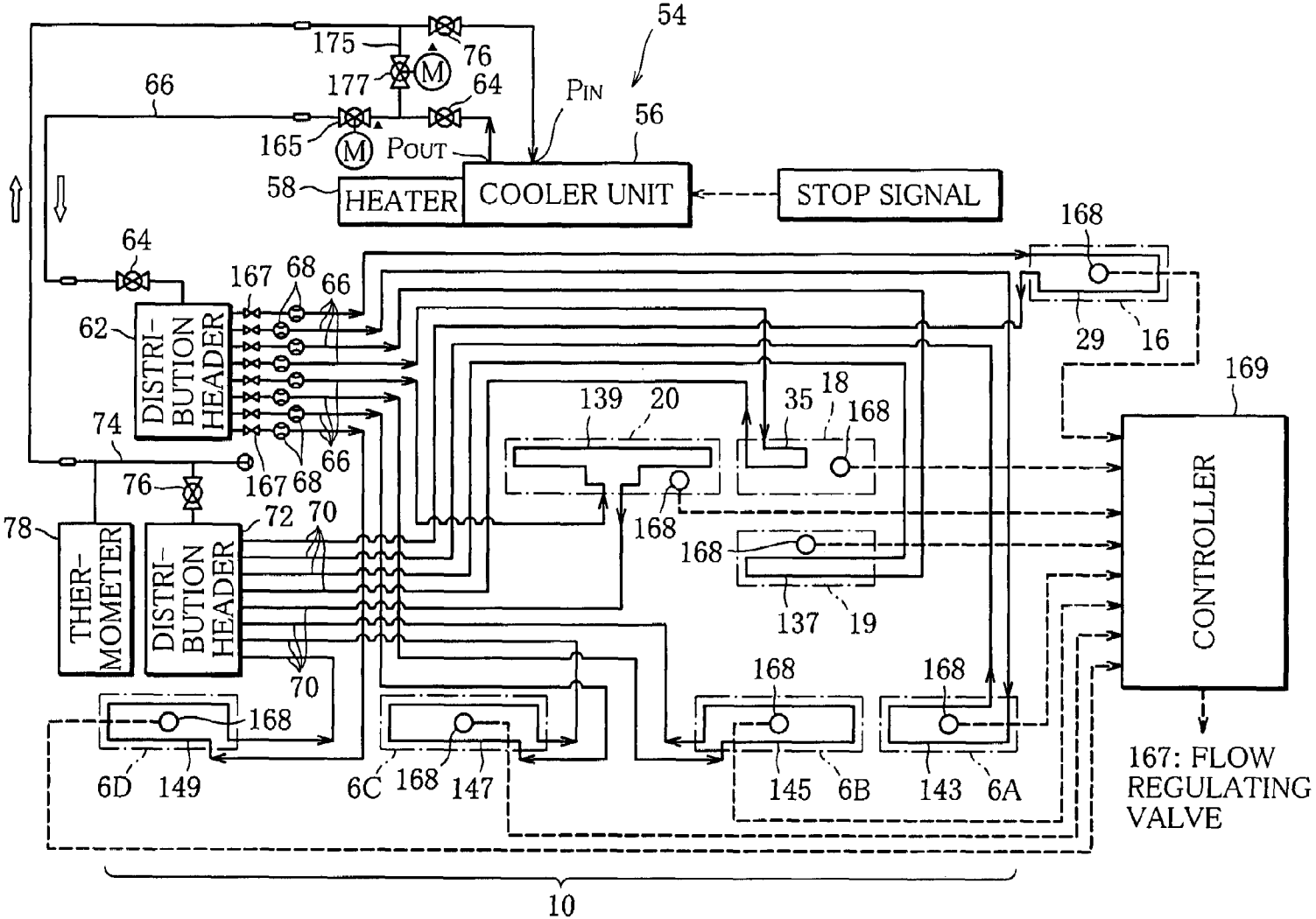
FIG. 18 is a diagram showing a circuit for supplying the coolant to cooling passages of the wrapping section of FIG. 8.

Since the portions 6C and 6D have the same internal configuration with the portion 6B, specific illustration of cooling passages in the portions 6C and 6D is omitted. The cooling passages in the portions 6C and 6D are both U-shaped. In FIG. 18, the cooling passages of the portions 6C and 6D are denoted by reference numerals 147 and 149, respectively. The portions 6C and 6D also have therein their respective heat pipes (not shown), which resemble the heat pipes 144 and 152, right under the molding groove 8.

The aforementioned short holder 18 may also have therein a heat pipe (not shown) that resembles the heat pipes 144 and 152.

Figure 15:
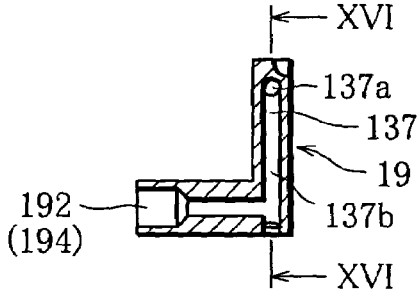
FIG. 15 is a sectional view of a front strip of FIG. 8.
Figure 16:
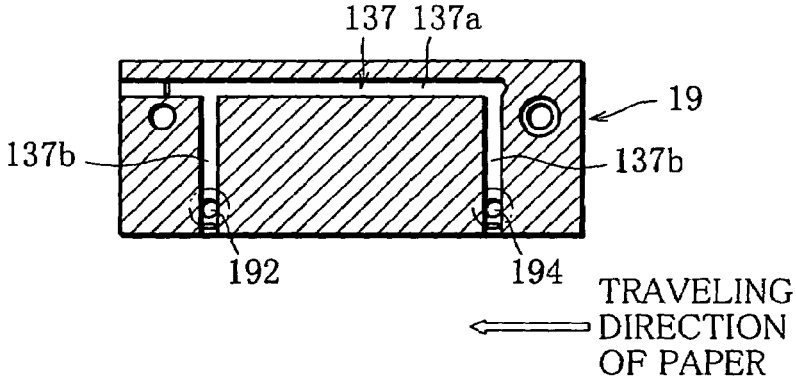
FIG. 16 is a sectional view taken along line XVI-XVI of FIG. 15.

FIGS. 15 and 16 show the internal construction of the aforementioned front strip 19. A cooling passage 137 is formed in the front strip 19. The cooling passage 137 has a horizontal portion 137*a* that extends in the traveling direction of the paper P and vertical portions 137*b* that are perpendicular to the opposite ends of the horizontal portion 137*a*, respectively. The vertical portions 137*b* open in the front face of the front strip 19 through ports 192 and 194. These ports 192 and 194 are connected to an inlet connector (not shown) and an outlet connector (not shown), respectively. In the front strip 19, the horizontal portion 137*a* of the cooling passage 137 is situated in the region that guides the other side edge of the paper P.

Figure 17:
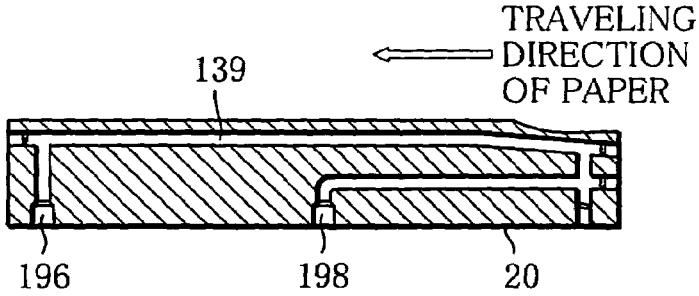
FIG. 17 is a sectional view of a long holder of FIG. 8.

FIG. 17 shows the internal construction of the long holder 20. A cooling passage 139 is formed in the long holder 20. The cooling passage 139 extends in the traveling direction of the paper P, and the opposite ends of the cooling passage 139 open in the front face of the long holder 20 through ports 196 and 198. These ports 196 and 198 are connected to an inlet connector (not shown) and an outlet connector (not shown), respectively. As seen from FIG. 17, that region of the cooling passage 139 on the side of the port 198 has a dual passage structure.

FIG. 18 shows a circuit for feeding the coolant to the individual cooling passages (including the respective cooling passages 137 and 139 of the front strip 19 and the long holder 20).

Since the circuit of FIG. 18 is constructed basically in the same manner as the circuit of FIG. 7, only its differences will be described below.

First, the temperature regulator 54 is actuated before the start of operation of the cigarette manufacturing machine or in association with the operation. On the other hand, the temperature regulator 54 receives a stop signal the moment the operation of the cigarette manufacturing machine is stopped, whereupon the operation of the regulator 54 is stopped immediately.

The feed line 60 is fitted with a motor-driven metering valve 165 between the two valves 64. Further, the feed line 60 has a bypass line 175 that extends from between the metering valve 165 and the valve 64 on the side of the unit cooler 56. On the upper-stream side of the valve 76 on the side of the unit cooler 56, the bypass line 175 is connected to the return line 74. The bypass line 175 is fitted with a motor-driven metering valve 177.

Each distribution line 66 is fitted with a solenoid-operated flow regulating valve 167 between the distribution header 62 and the flow meter 68. The respective openings of these flow regulating valves 167 are adjusted independently by means of a controller 169. More specifically, thermometers 168 are located individually in the tongue 16, short holder 18, front strip 19, and portions 6A to 6D of the forming bed 6. These thermometers 168 detect the respective temperatures of the aforesaid individual parts and supply the resulting detection signals to the controller 169.

The circuit of FIG. 18 uses the coolant compulsorily to cool the front strip 19 and the long holder 20, as well as the tongue 16, short holder 18, and portions 6A to 6D of the forming bed 6, thereby preventing them from overheating.

Thus, the garniture tape 10 and the cut tobacco K are prevented from overheating, and the lifetime of the garniture tape 10 lengthens. In consequence, the frequency of change of the garniture tape 10 is lowered, and the operating efficiency of the cigarette manufacturing machine, that is, its production capacity is improved. Further, the flavor and taste of the cut tobacco K can be also maintained.

Since the portions 6A to 6D of the forming bed 6 are cooled independently, the cooling effect of the forming bed 6 is high. Therefore, the forming bed 6 can be kept at a given temperature or below throughout its length. Since the portions 6A to 6D individually have the heat pipes 144 and 152 therein, moreover, the respective temperature distributions of the portions 6A to 6D are also uniform.

Figure 19:
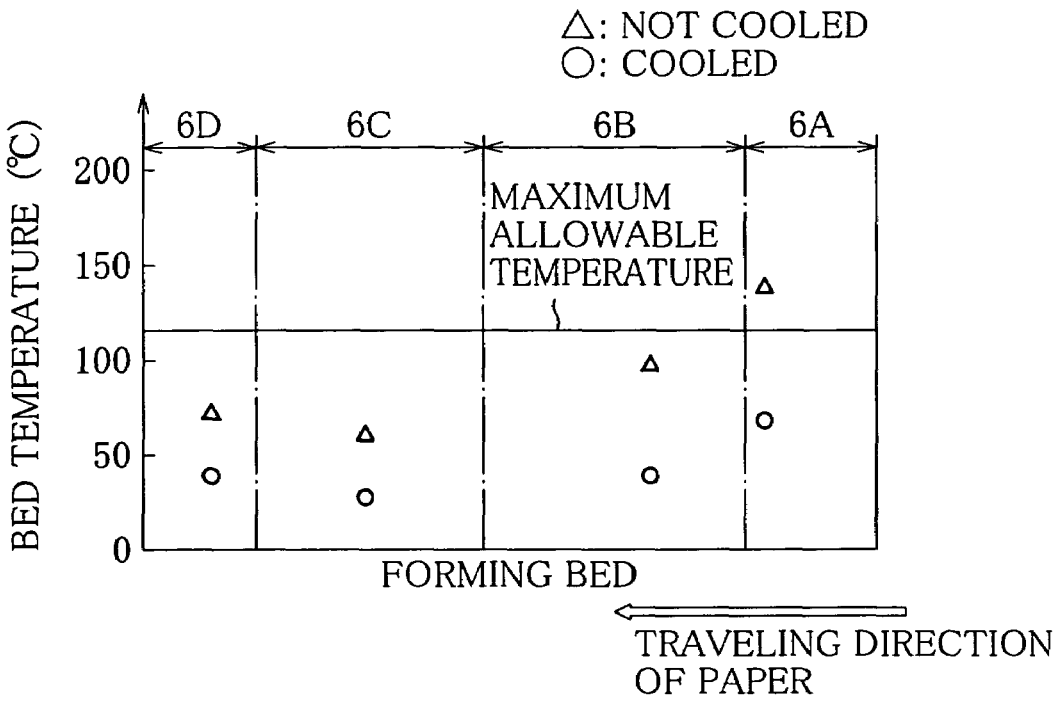
FIG. 19 is a graph showing the temperature distribution of the forming bed of FIG. 8.

FIG. 19 shows the temperature distribution of the forming bed 6 during the operation of the cigarette manufacturing machine.

In FIG. 19, circles (○) individually represent the respective temperatures of the portions 6A to 6D for the case where the forming bed 6 is cooled by means of the cooling passages 143, 145, 147 and 149, while triangles (Δ) represent the respective temperatures of the portions 6A to 6D for the case where the forming bed 6 is not cooled. In this case, the cigarette manufacturing machine is operated at a manufacturing speed for the manufacture of 14,000 cigarettes per minute in view of a single line, and the temperature of the coolant fed to the individual cooling passages is 10° C.

As seen from FIG. 19, the portion 6A of the forming bed 6 is heated to a temperature higher than those of any other portions. This implies that the highest frictional heat is applied to the portion 6A, since the cut tobacco K is compression-molded by means of the tongue 16 that is located right over the portion 6A.

If the forming bed 6 is not cooled, the respective temperatures of the portions 6A and 6B are higher than the maximum allowable temperature (about 120° C.) of the garniture tape 10. As the forming bed 6 is cooled, on the other hand, the temperature of any of the portions 6A to 6D is lower than the maximum allowable temperature (about 120° C.) of the garniture tape 10.

Since the tongue 16, short holder 18, front strip 19, and long holder 20, as well as the portions 6A to 6D of the forming bed 6, are cooled independently, on the other hand, the whole upper wrapping section 4*b* can be cooled satisfactorily. Thus, cut tobacco can be effectively prevented from overheating, and the flavor and taste of the cut tobacco cannot be worsened.

Since the short holder 18 has the heat pipe therein, the cut tobacco in the short holder 18 can be more securely prevented from overheating. The tongue 16, front strip 19, and long holder 20 may also have heat pipes, individually, therein.

When the operation of the cigarette manufacturing machine is stopped, the operation of the unit cooler 56 is stopped immediately. While the operation of the cigarette manufacturing machine is off, various parts of the wrapping section 4 cannot be overcooled, so that there is no possibility of sweating that is attributable to overcooling.

Further, the controller 169 adjusts the respective openings of the flow regulating valves 167 in accordance with the detection signals from the temperature sensors 168. In consequence, the quantities of coolant supply to the respective cooling passages of the tongue 16, short holder 18, front strip 19, long holder 20, and portions 6A to 6D of the forming bed 6 are adjusted independently, so that the individual parts of the wrapping section 4 can be kept at the aforesaid maximum allowable temperature or below.

The present invention is not limited to the cooling systems of the first and second embodiments, and may be changed variously.

Figure 20:
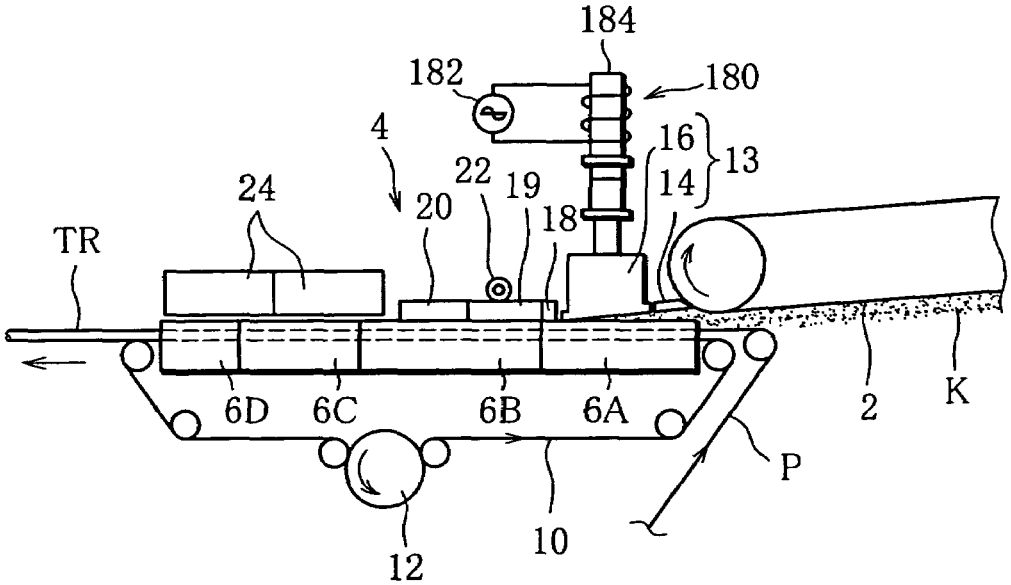
FIG. 20 is a schematic view showing a cigarette manufacturing machine according to a third embodiment.

As shown in FIG. 20, a cigarette manufacturing machine according to a third embodiment may further comprise an ultrasonic vibration unit 180, which vibrates a tongue 16 vertically or in the traveling direction of the garniture tape 10. The ultrasonic vibration unit 180 has an oscillator 182 and a vibrator 184. In this case, the inlet connector 30 and the outlet connector of the tongue 16 are formed of synthetic resin, and the tongue 16 is separate from a shoe 14.

When the tongue 16 is vibrated by means of ultrasonic waves that the ultrasonic vibration unit 180 generates, the sliding resistance of the cut tobacco K on the tongue 16 is reduced considerably. The vibration of the tongue 16 increases heat release from the tongue 16. Since the tongue 16 is compulsorily cooled with the coolant, as mentioned before, however, the tongue 16 cannot be overheated.

Since the inlet connector 30 and the outlet connector of the tongue 16 are formed of synthetic resin, moreover, these connectors can absorb the vibration of the tongue 16, so that the inlet connector 30 and the outlet connector cannot be disconnected from the tongue 16. Since the shoe 14 is separate from the tongue 16, furthermore, the vibration of the tongue 16 cannot be transmitted to the shoe 14.

If the ultrasonic vibration of the tongue 16 prevents the coolant supply to the cooling passage 29 of the tongue 16, cooling air can be supplied to the cooling passage 29. Instead of the coolant, cooling air or cooling gas may be supplied to other cooling passages in the wrapping section 4 than the cooling passage 29 of the tongue 16.

Figure 21:
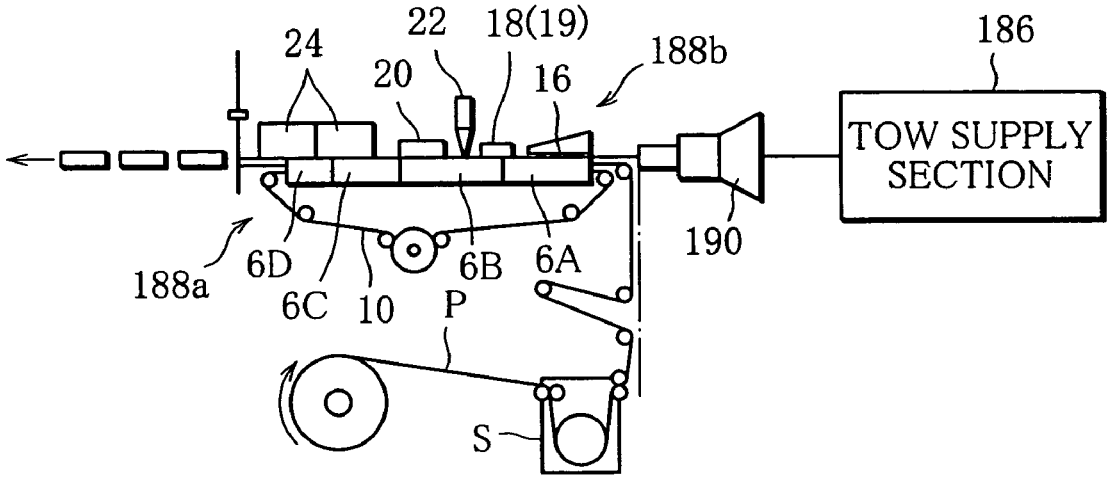
FIG. 21 is a schematic view showing a filter rod manufacturing machine having a cooling system.

FIG. 21 shows a filter rod manufacturing machine provided with the cooling system described above. This manufacturing machine is provided with a tow supply section 186 in place of the tobacco band 2 of the cigarette manufacturing machine. This section 186 supplies tow as a filter material to a wrapping section 188 through a trumpet guide 190. The wrapping section 188 has the same construction as that of the wrapping section 4 of the cigarette manufacturing machine. More specifically, the wrapping section 188 includes a lower wrapping section 188*b*, which is provided with the forming bed 6, and an upper wrapping section 188*a*, which is provided with the tongue 16, short holder 18, long holder 20, etc., and these sections 188*a* and 188*b* have the aforementioned cooling passages, individually.

The manufacturing machine of FIG. 21, like the manufacturing machine of FIG. 20, may include an ultrasonic vibration unit for the tongue 16.

Further, the present invention is not limited to manufacturing machines for cigarettes and filter rods, and is also applicable to any other manufacturing machines that use forming tapes such as garniture tapes to manufacture rod-shaped articles.

The invention claimed is:

1. A manufacturing machine for rod-shaped articles comprises:

a wrapping section supplied with a filler material and a wrapper and capable of forming a rod-shaped article by wrapping the filler material in the wrapper, said wrapping section including an endless tape, used to form the rod-shaped article and capable of running the wrapper together with the filler material in one direction, and a forming bed for guiding the endless tape in travel; and cooling means for cooling said wrapping section, said cooling means including a cooling passage formed at least in said forming bed and a circuit for circulating in and supplying a cooling medium to said cooling passage, wherein a forming bed of said wrapping section is divided into a plurality of regions adjoining one another in the traveling direction of the wrapper, and said cooling means includes a plurality of cooling passages formed independently in the regions, wherein said forming bed of said wrapping section is formed with an upper portion and a lower portion, said lower portion being divided into a plurality of individual regions adjoining one another in the traveling direction of the wrapper, said regions having grooves, which in conjunction with said upper portion form independent cooling passages in said forming bed.

2. The manufacturing machine according to claim 1, wherein said circuit includes a regulator used to adjust a temperature of the cooling medium and having a cooler and a heater, a feed line for feeding the cooling medium from the regulator to said cooling passages, and a return line for returning the cooling medium from said cooling passage to the regulator.

3. The manufacturing machine according to claim 2, wherein said circuit further includes a temperature sensor for detecting the temperature of the cooling medium in the return line.

4. The manufacturing machine according to claim 1, wherein said wrapping section further includes an upper wrapping section located over said forming bed, said upper wrapping section having a compression mold capable of defining a compression molding passage for the filler material in cooperation with said forming bed, a first mold located on a lower-stream side of said compression mold as viewed in the traveling direction of the wrapper and capable of curving one side edge of the wrapper in a circular arc to cover the filler material, and a second mold located on the lower-stream side of said first mold as viewed in the traveling direction of the wrapper and capable of curving the other side edge of the wrapper in a circular arc to cover the filler material; and said cooling means further includes a cooling passage formed at least in said compression mold, out of said molds, said cooling passage being supplied with the cooling medium from said circuit.

5. The manufacturing machine according to claim 4, further comprising vibrating means for vibrating said compression mold with ultrasonic waves.

6. The manufacturing machine according to claim 5, wherein said first mold includes a short holder for curving I the one side edge of the wrapper and a side edge guide for guiding the other side edge of the wrapper, and said cooling means further includes cooling passages formed individually in said short holder, side edge guide, and second mold, said cooling passages being supplied with the cooling medium from said circuit.

7. The manufacturing machine according to claim 6, wherein said circuit further includes branch lines diverging from the feed line and used to feed the cooling medium to the cooling passages, individually, temperature sensors for detecting respective temperatures of parts of said wrapping section having said cooling passages and outputting detection signals, individually, flow regulating halves inserted in said cooling passages, individually, and control means for adjusting respective openings of the corresponding flow regulating valves in accordance with the detection signals from the temperature sensors.

8. The manufacturing machine according to claim 1, wherein said forming bed has therein a heat pipe extending in the traveling direction of the wrapper.

9. The manufacturing machine according to claim 1, wherein said forming bed is divided into portions for the individual regions.

10. The manufacturing machine according to claim 9, wherein each said portion of said forming bed has therein a heat pipe extending in the traveling direction of the wrapper.

11. The manufacturing machine according to claim 1, wherein said wrapping section is supplied with cut tobacco as the filler material.

12. The manufacturing machine according to claim 1, wherein said wrapping section is supplied with a filter material as the filler material.

13. The manufacturing machine according to claim 1, wherein said lower portion of said forming bed includes grooves which, in conjunction with said upper portion, form said independent passages in said forming bed.

14. A manufacturing machine for rod-shaped articles comprises:

a wrapping section supplied with a filler material and a wrapper and capable of forming a rod-shaped article by wrapping the filler material in the wrapper, said wrapping section including an endless tape, used to form the rod-shaped article and capable of running the wrapper together with the filler material in one direction, and a forming bed for guiding the endless tape in travel; and cooling means for cooling said wrapping section, said cooling means including a cooling passage formed at least in said forming bed and a circuit for circulating in and supplying a cooling medium to said cooling passage, wherein a forming bed of said wrapping section is divided into a plurality of regions adjoining one another in the traveling direction of the wrapper, and said cooling means includes a plurality of cooling passages formed independently in the regions, and wherein said wrapping section further includes an upper wrapping section located over said forming bed, said upper wrapping section having a compression mold capable of defining a compression molding passage for the filler material in cooperation with said forming bed, a first mold located on a lower-stream side of said compression mold as viewed in the traveling direction of the wrapper and capable of curving one side edge of the wrapper in a circular arc to cover the filler material, and a second mold located on the lower-stream side of said first mold as viewed in the traveling direction of the wrapper and capable of curving the other side edge of the wrapper in a circular arc to cover the filler material; and said cooling means further includes a cooling passage formed at least in said compression mold, out of said molds, said cooling passage being supplied with the cooling medium from said circuit.

* * * * *